United States Patent [19]

Schafer

[11] Patent Number: 4,622,838

[45] Date of Patent: Nov. 18, 1986

[54] APPARATUS FOR MANUFACTURING FLEXIBLE CORRUGATED TUBES

[75] Inventor: Gunter Schafer, Ft. Lauderdale, Fla.

[73] Assignee: Security Lumber & Supply Co., Bradley, Ill.

[21] Appl. No.: 821,709

[22] Filed: Jan. 23, 1986

Related U.S. Application Data

[63] Continuation-in-part of Ser. No. 663,215, Oct. 22, 1984, abandoned, which is a continuation-in-part of Ser. No. 521,090, Aug. 10, 1983, abandoned, which is a continuation-in-part of Ser. No. 425,532, Sep. 28, 1982, abandoned.

[51] Int. Cl.[4] ..... B21C 37/12

[52] U.S. Cl. ..... 72/49; 72/50; 72/135

[58] Field of Search ..... 72/49, 50, 135, 183, 72/419; 228/17.7, 137, 145, 146, 147, 150; 242/67.3 R, 78.6, 78.7, 78.8

[56] References Cited

U.S. PATENT DOCUMENTS

| | | | |
|---|---|---|---|
| 3,472,463 | 10/1969 | Fedor et al. | 242/78.7 |
| 3,538,728 | 11/1970 | Trihey | 72/49 X |
| 3,815,639 | 6/1974 | Westerbarkey | 138/122 X |
| 3,865,146 | 2/1975 | Messerole | 72/50 X |
| 4,058,997 | 11/1977 | Siegwart | 72/50 |
| 4,114,432 | 9/1978 | Miura et al. | 72/135 |
| 4,141,385 | 2/1979 | Siegwart | 138/122 |
| 4,337,564 | 7/1982 | Menzel et al. | 72/50 X |
| 4,337,864 | 7/1982 | McLean | 242/76.3 R |
| 4,353,232 | 10/1982 | Viesters et al. | 72/50 |

FOREIGN PATENT DOCUMENTS

| | | | |
|---|---|---|---|
| 2027373 | 2/1980 | United Kingdom | 72/49 |
| 1564933 | 4/1980 | United Kingdom . | |

OTHER PUBLICATIONS

Gohl advertising piece.

*Primary Examiner*—E. Michael Combs
*Attorney, Agent, or Firm*—Wood, Dalton, Phillips, Mason & Rowe

[57] ABSTRACT

Apparatus for helically curling longitudinally corrugated thin strip material into a flexible corrugated tube has a curling unit with driven input rollers forming a nip that matches the strip, and a cassette for a reel of the material which is connected to said unit and has strip guide rollers immediately adjacent the input rollers. The curling unit has driven output rollers on an upright support to drive the strip, and a spider which is vertically adjustable on the support and carries strip guide rollers which are on spindles equidistant from the longitudinal axis of the forming tube, and radially adjustable, so that adjustment of the spider on the support and the spindles on the spider permits the unit to form tubes of different diameters. A locking mechanism intermittently crimps overlapping parts of the forming tube. A bending device aids in forming relatively stiff strip stock, and also aids in forming softer stock into very small diameter tubes.

26 Claims, 11 Drawing Figures

5
20
71
70
72
18
37
32
33
21
31
33A
6.
69
37A
34A
73
30
34
28
35A
25
109
29
35
110
123
111
112
4
S
68
119
113
108
120
27
24
121
94
106
38
23
59
92
26A
86
85
91
84
93A
38A
26
26F
93
83
89
90
57
38A
82
56
5
36
6.
107
22

7
78
64
32
32A
31A
31
30A
30
42
60
49
43
44
45
88
28
28A
87
120
53
54
55
121
27S
26E
27A
125A
126
125B
26D
26B
125
26C
41
59
86
23
85
26A
84
26F
26
39
83
89
40
58A
58
38A
23
22
57
82
7
56

37
71
64
63
77
78
65
70
72
79
48
49
62
76
47
50
80
66
51
46
44
52
69
60
73
75
45
81
53
67
61
54
55
68
74
38
26C
38
38A
26F
38A
26
39
39
40
58A
58
56
57

APPARATUS FOR MANUFACTURING FLEXIBLE CORRUGATED TUBES

RELATED APPLICATIONS

This application is a continuation-in-part of applicant's copending application Ser. No. 663,215, filed Oct. 22, 1984, abandoned which in turn was a continuation-in-part of applicant's copending application Ser. No. 521,090, filed Aug. 10, 1983, now abandoned; which in turn was a continuation-in-part of applicant's application Ser. No. 425,532, filed Sept. 28, 1982, now abandoned, with which it was copending.

BACKGROUND OF THE INVENTION

The present invention relates to an improved apparatus for forming a longitudinally corrugated thin strip into a flexible corrugated tube generally like that disclosed in U.S. Pat. No. 4,141,385, issued Feb. 27, 1979.

The prior art apparatus known to applicant which is pertinent to the present apparatus includes that of U.S. Pat. No. 4,058,997, issued Nov. 22, 1977; U.S. Pat. No. 4,353,232, issued Oct. 12, 1982 on an application filed Jan. 28, 1980; and United Kingdom application No. 2027373A, published Feb. 20, 1980.

Apparatus of the type disclosed in U.S. Pat. No. 4,058,997 may be used to produce tubes of different diameters only by removing from the apparatus a plate which carries a circle of forming rollers which are tangent to a circle of one diameter, and replacing that plate with another one which carries rollers that are tangent to a circle of a different diameter. As a result, switching the machine from the manufacture of a tube of one diameter to that of another diameter is quite a complex and time consuming job.

U.S. Pat. No. 4,353,232 has an adjusting arrangement to make ducts of different sizes, but adjustment is relatively slow because each of the curling guide rollers must be individually removed from one mounting hole and firmly secured in another mounting hole at a different radial position; and in addition the required change in the helix angle for ducts of different diameters must also be separately set.

The apparatus of published U.K. application No. 2027373A has a mechanism for simultaneously moving all the curling guide rollers from one radial position to another; but the mechanism is cumbersome because the adjustments function from the outer periphery of the curling head, which requires a succession of connected drive shafts around a circumference which must be substantially larger than that of the largest duct to be formed.

A large percentage of the flexible corrugated tubes made in this type of machine are used for air conditioning ducts, and any particular air conditioning installation usually requires ducts in several different sizes. A portable duct curling machine may be used to produce duct as needed at a job site, and there are portable units for this purpose. In another system a duct curling machine is located so as to serve heating and air conditioning contractors in a relatively small area to custom produce their needs for specific jobs. This has the advantage of offering better quality control than is usual with "on site" fabrication.

Portable apparatus of a type heretofore developed by the present inventor in Germany utilizes a cassette to receive a reel of precorrugated strip which is used in the fabrication of the flexible corrugated tube.

SUMMARY OF THE INVENTION

In accordance with the present invention, a portable apparatus for manufacturing flexible corrugated tube includes a cassette to receive a reel of longitudinally corrugated strip, and an outfeed opening of the cassette is provided with a pair of guide rollers which have intermeshing arcuate lands and grooves forming a nip that matches the corrugations of the strip, and when the cassette is hung on the frame of the curling apparatus, the nip of the guide rollers is immediately adjacent and coplanar with the nip of driven infeed rollers which also exactly match the corrugations of the strip. Accordingly, the feed of the strip into the curling apparatus is carefully controlled, and any deviations in the corrugations or possible deformations in the edges of the strip are eliminated before the strip enters the curling rollers.

Further, the rollers which are arranged in a circle to determine the diameter of the tube being produced by the apparatus are carried upon a spider which is vertically adjustable relative to strip outfeed rollers that drive the strip into the circular array of curling rollers. The spider is movable vertically relative to the outfeed rollers so as to change the distance from the nip of the outfeed rollers to the longitudinal axis about which the curling die rollers form a circle, and at the same time all of the curling die rollers are radially adjustable with reference to that axis so as to permit the apparatus to be very simply adjusted to produce tubes of different diameters.

In the preferred embodiment disclosed, a single manual adjusting crank on the axis of the duct being formed serves to move the spider vertically relative to the nip of the outfeed rollers, and at the same time acts through an array of radially outwardly extending shafts to move all of the curling die rollers radially to accomplish the desired adjustment of diameter in a single operation. At the same time the spider rotates about a vertical axis to automatically adjust the helix angle to the diameter of the duct being formed.

The apparatus of the present invention may be readily adjusted to produce corrugated tube from about 50.8 mm (2 inches) to about 508 mm (20 inches) in diameter.

THE DRAWINGS

DETAILED DESCRIPTION OF THE INVENTION

Figure 1:
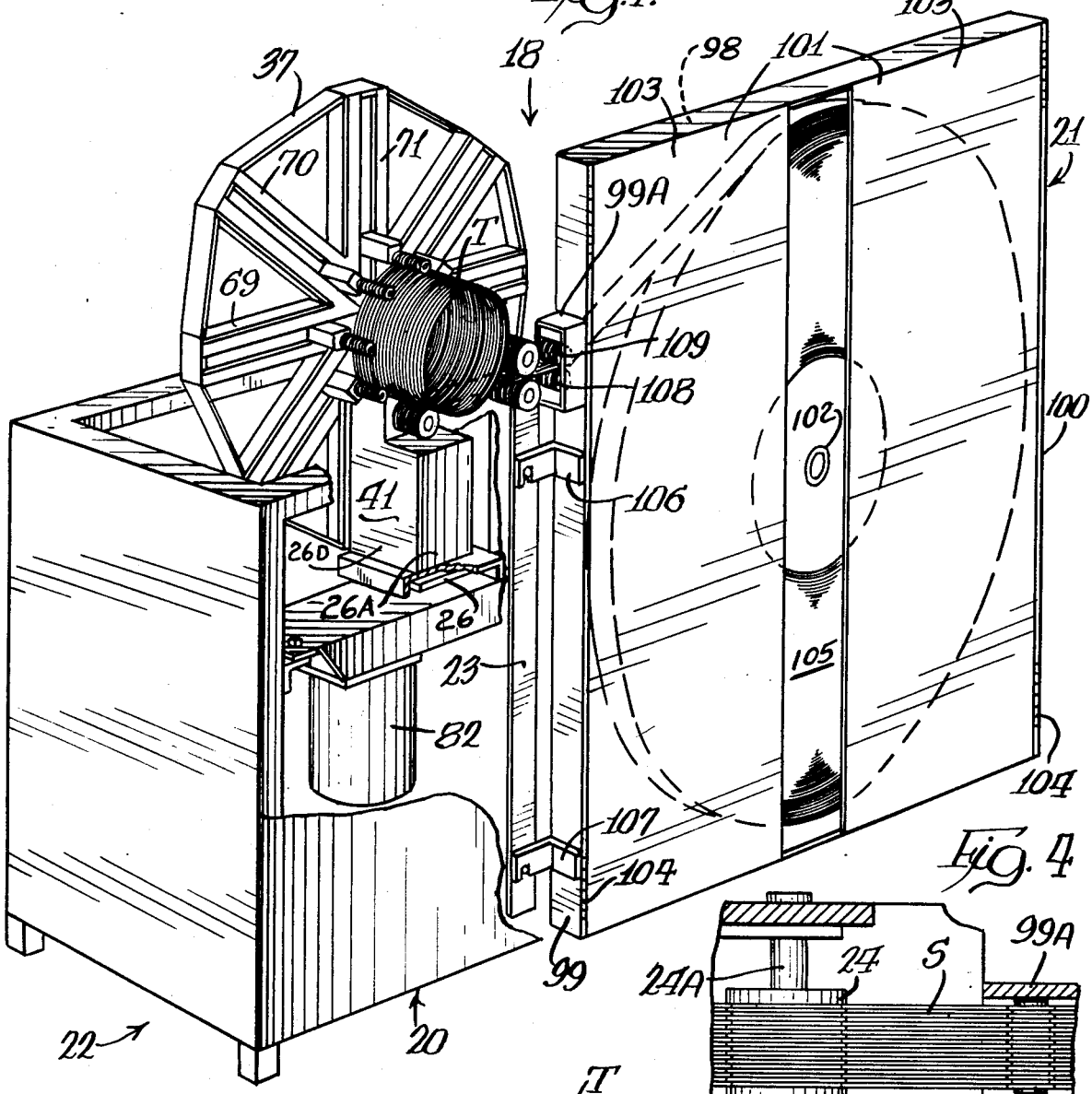
FIG. 1 is a schematic perspective view of the present curling apparatus to show the relationship between the curling unit and the cassette, parts including a bending device being omitted for clarity.
Figure 2:
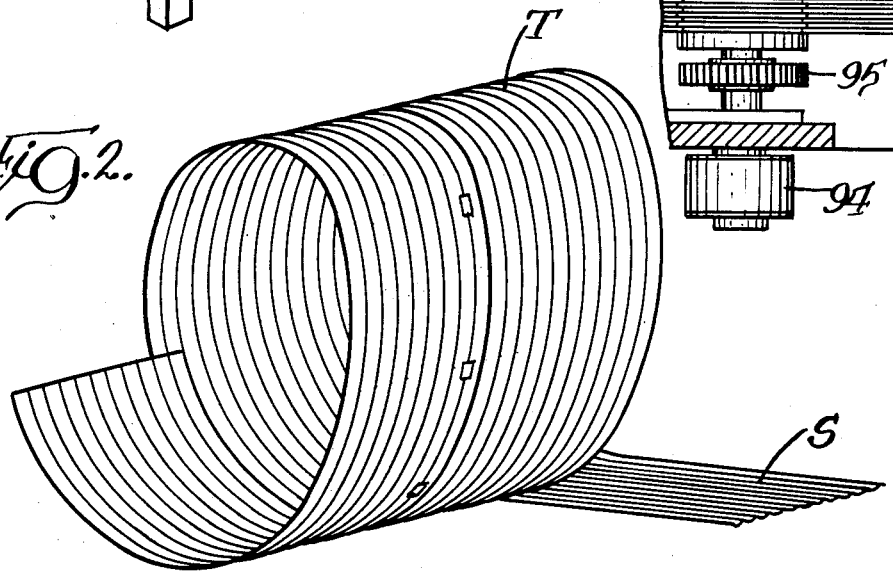
FIG. 2 is a fragmentary view of a part of a corrugated strip curled into a segment of a tube.
Figure 3:
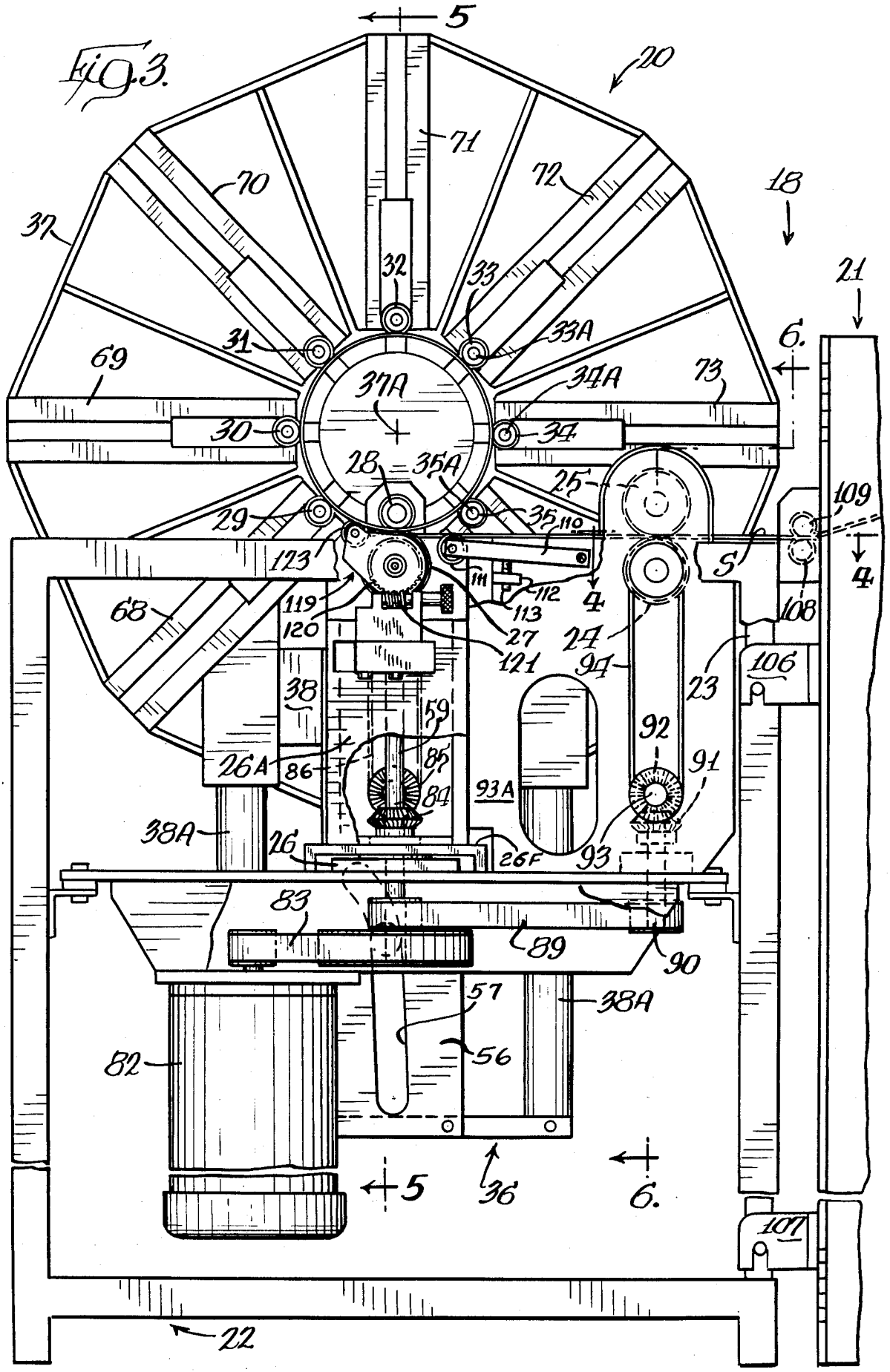
FIG. 3 is a front elevational view of the curling apparatus of the invention including a bending device, with parts omitted and with parts broken away for clarity and with only the immediately adjacent part of the cassette illustrated.

Referring to the drawings in detail, and referring first to FIGS. 1-3, a tube forming apparatus, indicated generally at 18, includes a curling unit, indicated generally at 20 and a cassette 21 from which the unit 20 receives precorrugated aluminum strip S to form into flexible tube T.

The tube forming apparatus 20 has a base 22 that includes a frame 23, and cooperating input rollers 24 and 25 that have intermeshing arcuate lands L and grooves G (FIG. 8) and are mounted on the frame to feed the precorrugated strips S received from the cassette 21.

Figure 5:
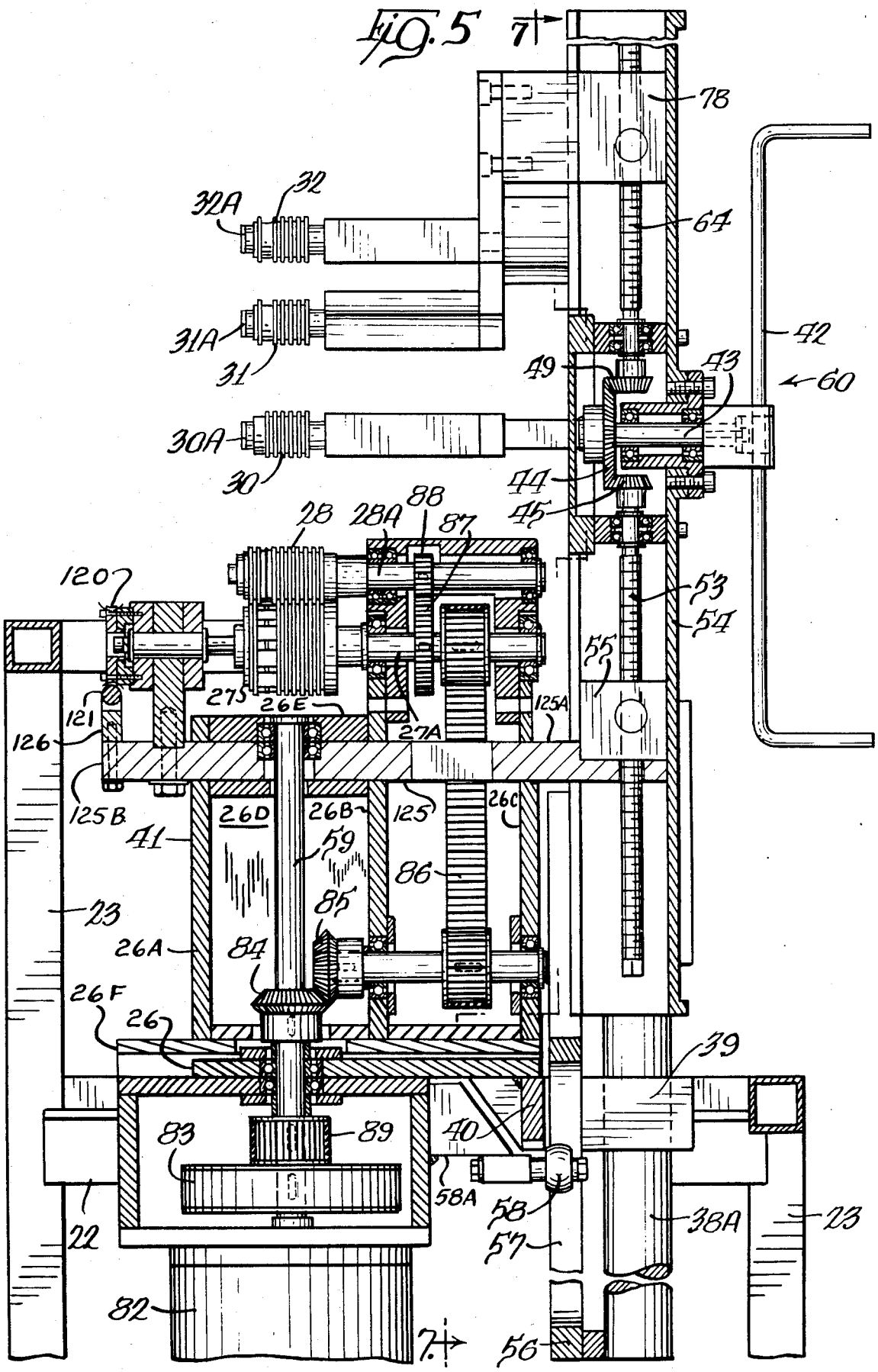
FIG. 5 is a fragmentary sectional view on an enlarged scale, including a bending device, and with parts broken away, taken substantially as indicated along the line 5—5 of FIG. 3
Figure 10:
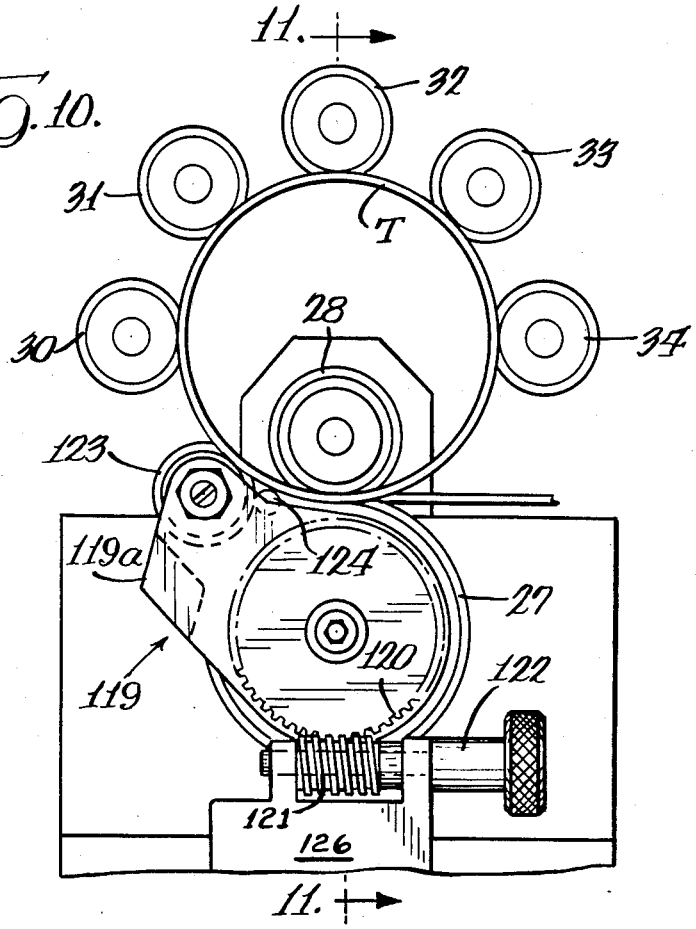
FIG. 10 is a fragmentary elevational view, which is partially schematic, illustrating the bending device in detail, and showing the curling unit adjusted to form a tube of very small diameter.

The curling die unit 20 also includes a base plate 26 that is rotatable on the base 22 on a vertical axis as will be described in more detail. An upright support defining a gear housing 41 consists of three parallel upright walls 26A, 26B and 26C, end walls 26D, and a top wall 26E, all supported upon a bridge frame 26F that spans the base plate 26 as best seen in FIGS. 3 and 5. The walls 26A through 26D are all bolted to the bridge frame. Output rollers 27 and 28 matching the input rollers 24 and 25 have respective shafts 27A and 28A journalled in bearings in the walls 26B and 26C. The output rollers 27 and 28 receive the strip S from the input rollers 24 and 25 and feed it into a bending device 119 that has a bending roller 123 (detailed in FIG. 10), and a series of idler curling die rollers 29-35 which are journalled on respective spindles 29A-35A that are mounted in a circular configuration on a curling die base 36 that is vertically adjustable on the base plate 26. The spindles 29A-35A are readily removed.

The idler curling die rollers 29-35 may float axially about 2.54 mm (0.1 inch) on their respective spindles 29A-35A; and this is important to permit the apparatus, without modification, to make corrugated tubes having either one or two corrugations overlapped on adjacent lays. A single overlap may be used on tubes of no more than about 30.48 cm (12 inches). For larger sizes, for long unbroken runs, and for tubes intended for pressures materially higher than those in heating and air conditioning systems, a two corrugation overlap is essential.

Figure 8:
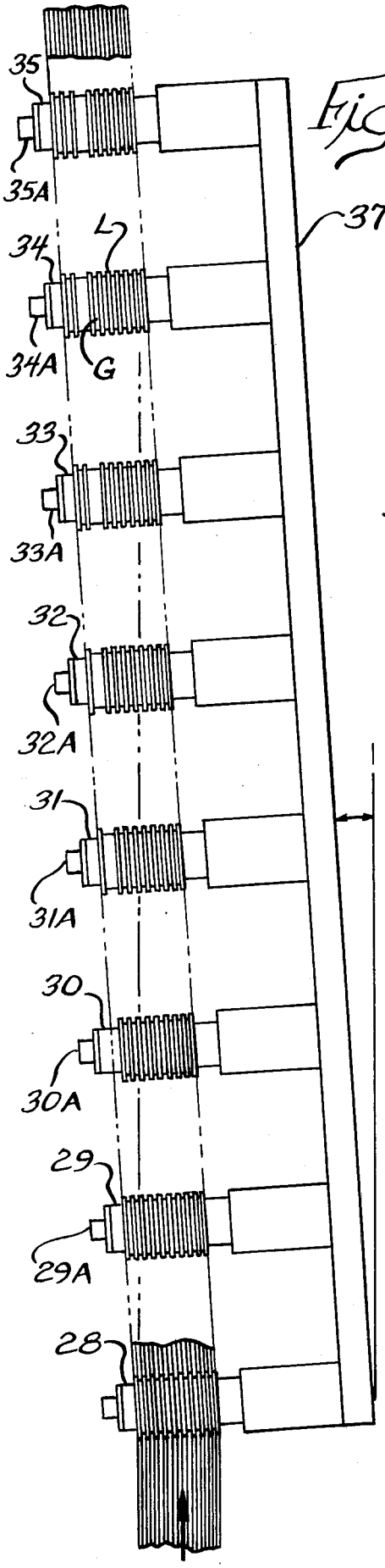
FIG. 8 is a fragmentary schematic view of the curling die rollers.

Also to form the two corrugation overlap it is necessary to omit a land from some of the guide rollers. As seen in FIG. 8, the roller 29 has no land omitted; the roller 30 has the first land at the outer end omitted; the rollers 31 and 32 include the first land at the outer end but have the second land omitted; the rollers 33 and 34 include the first and second lands at the outer end but have the third land omitted; and the roller 35 includes the first three lands at the outer end but has the fourth land omitted.

Pivotally mounted on the base 22 adjacent the input rollers 24 and 25 is a bifurcated arm 110 which has a free end close to the output rollers; and journalled at said free end is a directing roller 111 which has lands and grooves aligned with those of the input rollers and the output rollers. A bracket 112 on the base 22 is provided with an upright adjusting screw 113 that supports the free end of the arm 110 so as to permit adjustment of the directing roller 111 relative to the input rollers and the output rollers for a reason which will be described.

The curling die base 36 includes a roller supporting spider 37, a frame 38 and guide posts 38A that are guided in sleeves 39 which are mounted on a cross bar 40 that is fixed to the rear of base plate 26. The radial distance of each of the rollers 29-35 from a center 37A of the roller supporting spider 37, which coincides with the longitudinal axis of a forming tube T, may be adjusted so as to allow the manufacture of flexible tubes having different diameters. Furthermore, when the radial distance of the rollers 29-35 from the center 37A is changed, the spider 36 and the rollers 29-35 are moved vertically on the base plate 26 toward or away from the output rollers 27 and 28 so that the center 37A of the spider 37 always coincides with the longitudinal axis of the flexible tube being formed. During this vertical adjustment of the spider, the base plate 26 is rotated on the base 22 about its vertical axis, so the angle of the helix formed by spiral winding the corrugated strip S matches the diameter of the forming tube T. A small tube requires a large helix angle, while a large tube requires a small helix angle.

Figure 6:
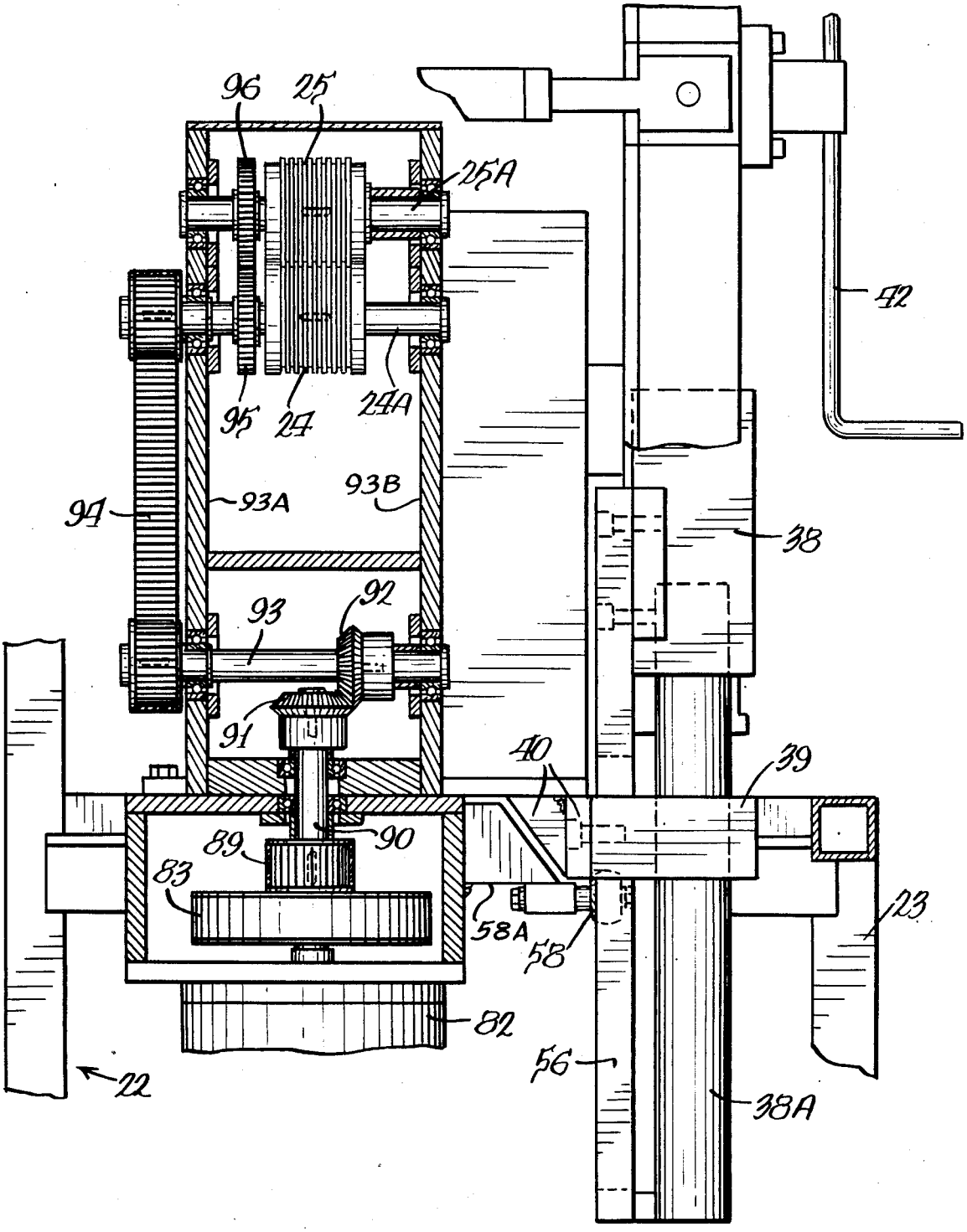
FIG. 6 is a fragmentary sectional view taken substantially as indicated along the line 6—6 of FIG. 3.
Figure 7:
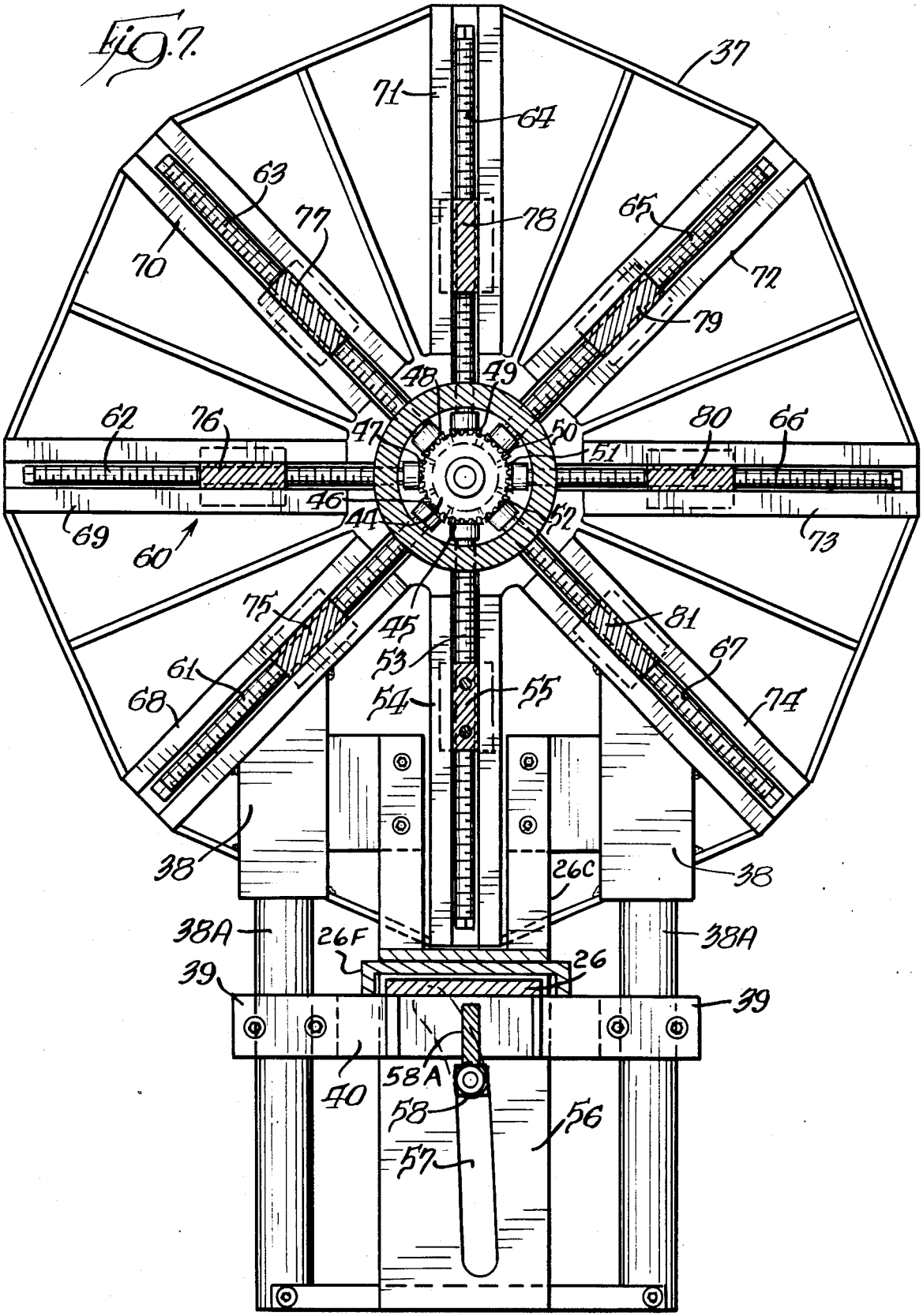
FIG. 7 is a fragmentary sectional view taken substantially as indicated along the line 7—7 of FIG. 4.

Referring especially to FIGS. 5-7, the vertical adjustment of the curling die base 36 and the radial adjustment of the rollers 29-35 are both accomplished by using a hand crank 42 to turn a spindle 43 which carries an adjusting bevel drive gear 44 that drives a cluster of bevel pinions 45-52 (see FIG. 7).

The bevel pinion 45 is attached to the upper end of an upright adjusting screw 53 which extends within a screw housing 54 of the curling die base 36 and is vertically movable through a threaded nut 55 which is disposed within the housing 54 and is part of a block that extends outwardly through an elongate opening of the housing 54 and is supported by the base plate 26. Rotation of the spindle 43 causes a corresponding rotation of the upright screw 53 within the nut 55, and this causes the entire curling die base 36 to move vertically with respect to the output rollers 27-28 which are carried on the gear housing 41.

Secured to the frame 38 is a cam plate 56 that includes a cam slot 57 which traverses a cam follower 58 that is fixedly secured to a bracket 58A on the base 22. Vertical movement of the curling die base 36 causes the cam slot 57 to traverse the cam follower 58, and this causes the upright support 26 to rotate about its axis, which is the axis of a vertical shaft 59 that is bearing supported within the base 22. The pivotal movement of the parts changes the angle of the helix to match the diameter of the tube being formed, and the amount of the pivotal movement is controlled by the shape of the cam slot 57. Confinement of the cam follower 58 in the cam slot 57 fixes the base plate 36 and the curling die base 38 in their adjusted positions.

As seen in FIG. 7, the pinions 46-52 are part of spindle adjusting means 60 for adjusting the radial positions of the curling die roller spindles 29A-35A. The pinions 46-52 are mounted on respective radial adjusting screws 61-67 that are carried within radial screw housings 68–74 of the spider 37. The radial adjusting screws 61–67 engage respective spindle nuts 75–81 which are parts of slide blocks on which the spindles 29A–35A are respectively mounted. Therefore, all the curling die rollers 29–35 move radially in unison toward or away from the center 37A of the roller spindle 37 in response to rotation of the spindle 43.

Thus, the following three actions occur when the spindle 43 is rotated:

1. The center 37A of the spider 37 moves vertically toward or away from the output rollers 27–28, which remain stationary;
2. Each of the rollers 29–35 moves in a radial direction relative to the center 37A; and
3. The base plate 26 rotates about the axis of the vertical shaft 59 to change the helix angle.

Figure 4:
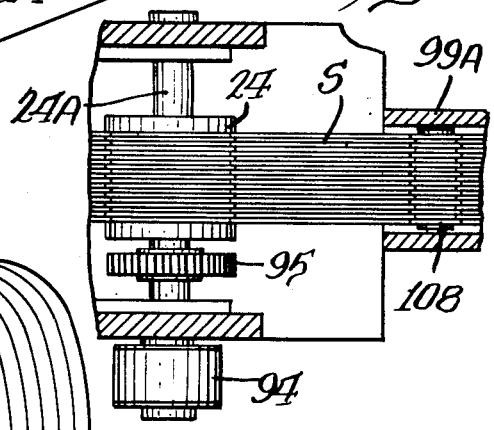
FIG. 4 is a fragmentary sectional view on an enlarged scale taken substantially as indicated along the line 4—4 of FIG. 3.

As best seen in FIGS. 3 and 4, a motor 82 is mounted upon the base 22 and is connected through a timing belt drive 83 to the upright shaft 59. The shaft 59 is coupled via bevel gears 84–85 and a timing belt drive 86 to the lower output shaft 27A which mounts the lower output roller 27. The lower output shaft 27A is also coupled through gears 87–88 to the upper output shaft 28A which mounts the upper output roller 28.

Referring also to FIG. 6, the input rollers 24–25 are driven by means of a second timing belt drive 89 from the upright shaft 59 to a shaft 90. A bevel gear 91 on the shaft 90 meshes with a bevel gear 92 on a jack shaft 93 to drive a further timing belt drive 94 for a lower input roller shaft 24A which mounts the lower input roller 24. The lower input roller shaft 24A, in turn, is connected by gears 95 and 96 to an upper input roller shaft 25A which mounts the upper input roller 25. The jack shaft 93 and input roller shafts 24A and 25A are all journalled in bearings that are carried in walls 93A and 93B which connect to the walls 26A and 26B.

Referring now to FIG. 1, the cassette 21 has a plurality of sides including a rear side 98, lateral sides 99 and 100, and a front side 101. A spindle 102 is mounted on the rear side 98, there is a strip outfeed opening 99A in the lateral side 99, and the front side 101 consists of a pair of doors 103 on hinges 104 mounted on the lateral sides 99 and 100. The spindle 102 receives a reel 105 of the corrugated strip S.

Upper mounting brackets 106 and lower brackets 107 detachably connect the cassette 21 to the frame 23 of the curling unit 20, with the strip outfeed opening 99A immediately adjacent the input rollers 24 and 25. In the opening 99A is a pair of strip guide rollers 108–109 which have a nip coplanar with that of the input rollers 24 and 25 when the cassette is mounted upon the curling frame 23.

When a new reel 105 of corrugated strip S is mounted in the cassette, the end of the strip must be guided through the nip of the guide rollers 108–109, through the nip of the input rollers 24–25, over the directing roller 111, and through the nip of the output rollers 27–28. The end of the strip is then fed into tangency with the inner side of the bending roller 123 as hereinafter described, to direct the end of the strip into tangency with the first idler curling die roller 29.

As the corrugated strip S is removed from the reel 105, the guide rollers 108–109 assure that it will be properly fed into the infeed rollers 24–25 as the outer diameter of the strip remaining on the reel decreases. When the supply of strip on a reel 105 is exhausted the front doors 103 are opened, the exhausted reel is removed, a full reel is placed on the spindle 102, and the new strip is threaded through the guide rollers 108–109, etc.

It is apparent from the foregoing description that the guide rollers 108–109, the input rollers 24–25, and the output rollers 27–28, must all have arcuate lands L and grooves G which intermesh to form a nip that matches the corrugations of a strip S. The curling die rollers 29–35, the directing roller 111, and the bending roller 123 also have such lands and grooves.

Figure 11:
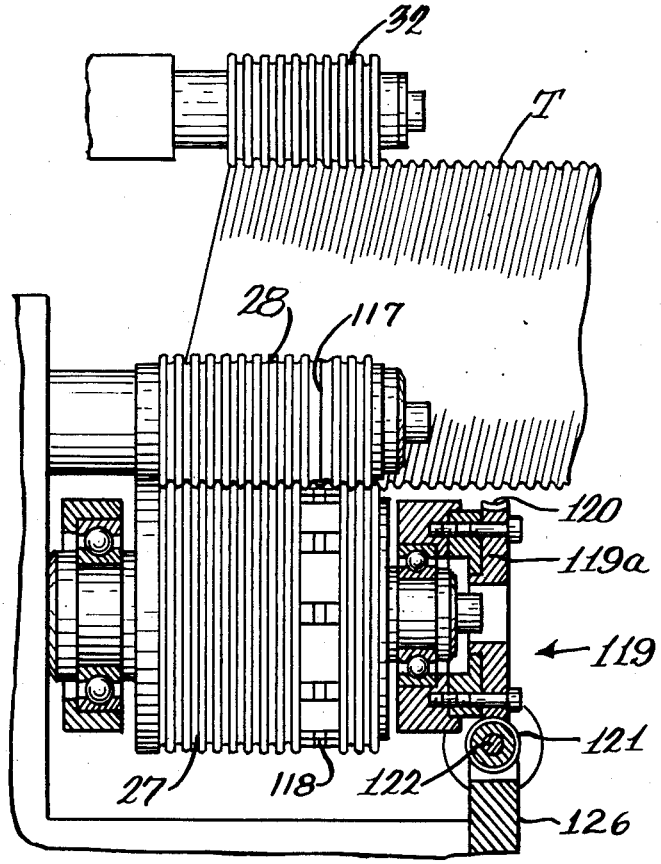
FIG. 11 is a fragmentary sectional view taken substantially as indicated along the line 11—11 of FIG. 10.

The apparatus is of the type which forms locking detents at intervals about the overlapping layers of the corrugated strip as it is being formed into a flexible tube. A mechanism for forming one type of locking detents is disclosed in U.S. Pat. No. 4,058,997, and the locking detent produced by that mechanism is shown in U.S. Pat. No. 4,141,385. Applicant'U.S. Pat. No. 4,509,560, issued Apr. 9, 1985, for Improved Locking Detent for Corrugated Tube, also discloses and claims a suitable locking detent. The location of a detent forming mechanism is indicated in FIG. 11 by the reference numerals 117 and 118.

Figure 9:
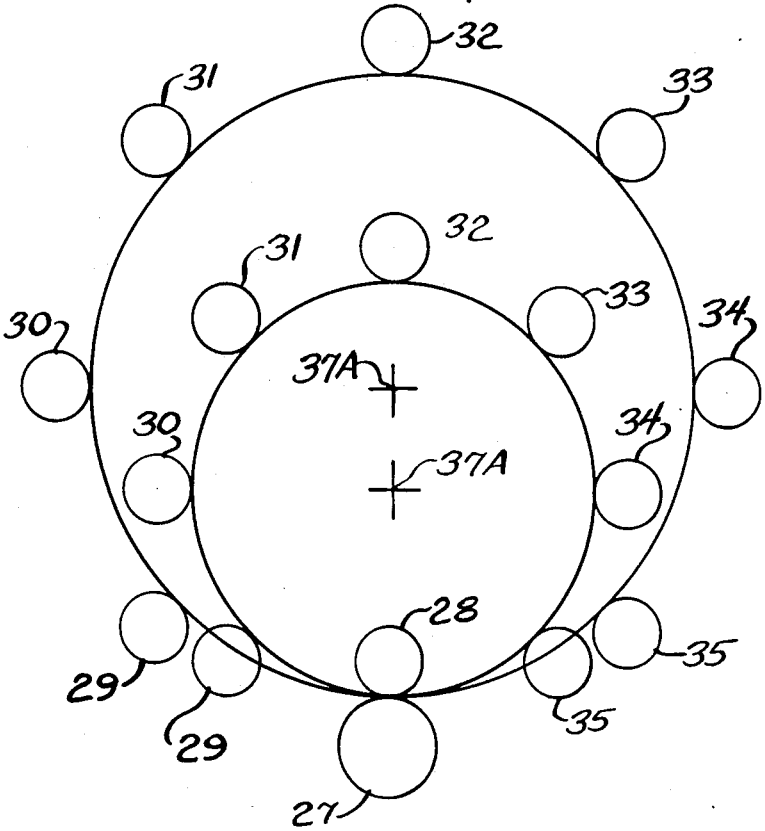
FIG. 9 is a diagrammatic view illustrating the relative positions of the curling die rollers with respect to the outfeed rollers and one another in two different adjusted positions of the spider.

The curling die is adjustable so that it may fabricate flexible tube from about 50.8 mm (2 inches) to about 508 mm (20 inches) in diameter. If a tube to be fabricated is to have a diameter in the extreme lower part of this range, then the rollers 29 and 35 must be removed as illustrated in FIG. 9.

The bending device 119 comprises a pivoted plate **119*a* which is mounted upon an arm 125 the rear portion 125*a* of which is secured to the frame 38, and the forward extremity 125*b* of which is forward of the outfeed rollers 27 and 28. The arm 125 is supported upon the plates 26A, 26B and 26C, and cooperates with the base plate 26 in supporting the curling die base 36. Said arm 125 has an opening for the vertical shaft 59 about which it pivots with the base plate 26, side recesses to afford clearance for the belt 86, and an opening for the adjusting screw 53. A block 126 at the forward extremity 125*b* of the arm journals a manually rotatable spindle 122 on which is formed a worm 121. A gear segment 120 on the plate 119*a* meshes with the worm 121 so that rotation of the spindle 122 pivots the plate 119*a* so as to change the position of the bending roller 123 that is journalled upon a spindle on the plate 119*a* where it normally occupies an operative position between the nip of the infeed rollers 27–28 and the first curling die roller 29. By reason of its mounting upon the arm 125, the bending roller 123 swings with the spider 37 and the curling die rollers 29–35. A bending pin 124 may also be used with the bending roller 123**.

Whether or not the bending device 119 is used during a curling operation depends both upon the diameter of the tube being formed and upon the stiffness of the material in the strip S.

The least expensive suitable aluminum stock which is available in the U.S. market is of the stiffness used in the standard aluminum foil trays in which frozen foods are packaged. That material is stiff enough that the bending device 119 desirably is used regardless of the diameter of the tube that is being formed. The manually rotatable spindle 122 with its worm 121 is used to locate the bending roller 123 in the proper position between the rollers 27–28 and the first idler roller 29 or 30, as the case may be, and the location of the roller 123 must be adjusted to coincide with the diameter.

Referring again to FIG. 3 and the directing roller 111, the upper surface of that roller is usually on a common plane with the upper surfaces of the input roller 24 and the output roller 27. When the bending roller 123 is lowered to form very small diameter tubes, the directing roller 111 is elevated slightly so the strip S is angled slightly downward into the nip of the output rollers 27–28.

At the present time any aluminum strip which is softer than that used for freezer trays must be custom fabricated, and it is thus enormously more expensive. However, where strip material of about half the hardness of the freezer tray stock is used, the bending device 119 is required only for the fabrication of tubes smaller than about 76.2 mm (3 inches); and for larger tubes the bending device may be swung entirely out of the way by turning the spindle 122.

The apparatus performs optimally with aluminum strip the nominal thickness of which is 0.0762 mm (0.003 inch), maximum 0.0889 mm (0.0035 inch). Strip that is 0.127 mm (0.005 inch) does not form satisfactory locking detents.

As seen in FIG. 9, when a tube of about 50.8 mm diameter (2 inches) is being formed, the axis of the bending roller 123 is almost precisely where the axis of the removed idler roller 129 is located.

The foregoing detailed description is given for clearness of understanding only and no unnecessary limitations should be understood therefrom, as modifications will be obvious to those skilled in the art.

I claim:

1. Apparatus for helically curling longitudinally corrugated thin strip material into a flexible corrugated tube, said apparatus comprising, in combination:

(a) a curling unit comprising, (1) a base that has opposite lateral sides, (2) two forwardly extending rotatably driven input rollers carried on said base near one of said opposite lateral sides, said input rollers having intermeshing arcuate lands and grooves forming a nip which matches the corrugations of a strip of material to be helically curled, (3) two forwardly extending rotatably driven output rollers supported on said base, said output rollers having intermeshing arcuate lands and grooves forming a nip to receive a strip of material from said input rollers, (4) idler rollers supported on the base which have arcuate lands and grooves to guide said strip of material from the input rollers in a helical path in which each successive turn of the strip passes through the nip of the output rollers in partially overlapped relationship with the strip entering said output rollers, and (5) locking means for crimping overlapping parts of said strip to lock said parts to one another; and (b) a cassette having (1) a frame with a plurality of sides, (2) means on said frame to rotatably mount a reel of said thin strip material, (3) a strip outfeed opening in one of said frame sides, (4) two guide rollers in said outfeed opening, said guide rollers having intermeshing arcuate lands and grooves forming a nip which matches the corrugations in said strip of material, and (5) means detachably connecting said cassette to the base with said one of said frame sides confronting said one lateral side of the base and with the nips of said guide rollers and of said input rollers immediately adjacent one another and substantially coplanar.

2. The combination of claim 1 in which one of the cassette frame sides comprises a pair of panels, and upright hinges one of which is on the cassette frame side having the strip outfeed, said panels being mounted on said hinges for movement between normal coplanar positions confining a reel in the cassette and substantially parallel positions permitting a new reel to be mounted in the cassette.

3. A cassette to receive a reel of longitudinally corrugated thin strip material which is to be helically curled in a curling apparatus to form a flexible corrugated tube, said curling apparatus having a base with opposite lateral sides, and driven input rollers with intermeshing lands and grooves forming a nip to receive the strip adjacent one of said opposite lateral sides, said cassette comprising, in combination:

a frame with a plurality of sides;

means on said frame to rotatably mount a reel of said longitudinally corrugated thin strip material;

a strip outfeed opening in one of said frame sides;

two guide rollers in said outfeed opening, said guide rollers having intermeshing arcuate lands and grooves which form a nip that matches the corrugations in said strip of material;

and means for detachably connecting said cassette to the base of a curling apparatus with said one of said frame sides confronting said one lateral side of the base and with the nips of said guide rollers and of the curling apparatus input rollers immediately adjacent one another and substantially coplanar.

4. The combination of claim 3 in which one of the cassette frame sides comprises a pair of panels, and upright hinges one of which is on the cassette frame side having the strip outfeed, said panels being mounted on said hinges for movement between normal coplanar positions confining a reel in the cassette and substantially parallel positions permitting a new reel to be mounted in the cassette.

5. Apparatus for helically curling longitudinally corrugated thin strip material into a flexible corrugated tube, said apparatus comprising, in combination:

a base;

two forwardly extending rotatably driven input rollers carried on said base, said input rollers having intermeshing arcuate lands and grooves forming an input nip which matches the corrugations of a thin strip of corrugated material entering said nip from a reel of said material, and said input rollers feeding said thin strip;

two forwardly extending rotatably driven output rollers supported on said base, said output rollers having intermeshing arcuate lands and grooves forming an output nip which is coplanar with the input nip to receive a strip of material fed by said input rollers, a directing roller positioned between the input rollers and the output rollers, said directing roller having arcuate lands and grooves over which the corrugated strip passes;

means for adjusting the vertical position of said directing roller relative to the plane of the input and output nips so as to vary the angle at which the strip enters the output nip;

a series of idler rollers supported on the base equidistant from a longitudinal axis, said idler rollers having arcuate lands and grooves to guide said strip of material from the input rollers in a helical path in which each successive turn of the strip passes through the nip of the output rollers in partially overlapped relationship with the strip entering said output rollers to form a tube that is concentric with said longitudinal axis;

first means for adjusting said idler rollers radially with respect to said longitudinal axis to form a flexible corrugated tube of a selected diameter ranging from about 50.8 mm (2 inches) to about 508 mm (20 inches);

second means for adjusting the location of said longitudinal axis vertically relative to the output nip;

and locking means for crimping overlapping parts of said strip to lock said parts to one another.

6. The combination of claim 5 which includes a bending roller supported on the base between the driven output rollers and the first of said series of idler rollers, said bending roller having arcuate lands and grooves matching those of the corrugated strip, and third adjusting means for moving said bending roller to a desired position with respect to said longitudinal axis independently of the operation of said first and second adjusting means to vary said position with the diameter of a tube being formed.

7. The combination of claim 5 that includes spindles on which the idler rollers are journalled, said spindles being longer than the rollers so the latter may float endwise to facilitate the production of a tube in which the overlap between successive turns of the strip is selectively either one land or two lands, and certain of said idler rollers having a land removed near the outer end to accommodate a forming tube that has a two land overlap.

8. The combination of claim 7 in which the first idler roller in the series has no land removed, subsequent rollers in the series each have one land removed, the first removed land is the outer end land, and on later rollers in the series the removed land is progressively farther from the outer end land.

9. The combination of claim 5 that includes spindles on which the idler rollers are journalled, said spindles being longer than the rollers so the latter may float endwise to facilitate the production of a tube in which the overlap between successive turns of the strip is selectively either one land or two lands, and certain of said idler rollers having a land removed near the outer end to accommodate a forming tube that has a two land overlap.

10. The combination of claim 9 in which the first idler roller in the series has no land removed, subsequent rollers in the series each have one land removed, the first removed land is the outer end land, and on later rollers in the series the removed land is progressively farther from the outer end land.

11. Apparatus for helically curling longitudinally corrugated thin strip material into a flexible corrugated tube, said apparatus comprising, in combination:

a base;

a base plate pivoted on said base for rotation about a vertical axis;

an upright support which is mounted on said base spanning said base plate;

two output rollers fixed to respective first and second forwardly extending driven shafts which are mounted on said upright support, said output rollers having intermeshing arcuate lands and grooves forming a nip which matches the corrugations of a strip of material to be helically curled so as to drive said strip;

a spider carried on said base plate;

a series of idler rollers mounted on said spider which have arcuate lands and grooves to guide said strip of material from the output rollers in a helical path in which each successive turn of the strip passes through the nip of the output rollers in partially overlapped relationship with the strip entering said output rollers, said idler rollers being journalled on spindles all of which are equidistant from the longitudinal axis of a tube formed by the curling of the strip;

spindle adjusting means comprising a gear drive, means journalling said gear drive on the spider for rotation about an axis which is a rearward projection of the longitudinal axis of the tube being formed, and a radially extending screw operatively associated with each spindle and drivingly connected to said gear drive for simultaneously moving all said spindles selectively radially outwardly or inwardly and retaining them in predetermined radially equidistant positions from said longitudinal axis;

spider adjusting means for moving the spider vertically on the upright support to change the distance between the output roller nip and said longitudinal axis, said spindle adjusting means and said spider adjusting means permitting the apparatus to form tubes of different diameters;

and locking means for crimping overlapping parts of said strip to lock said parts to one another.

12. The combination of claim 11 in which the spindle adjusting means and the spider adjusting means are operatively connected so that adjustment of all said spindles and said spider is carried out simultaneously.

13. The combination of claim 12 in which the spider adjusting means comprises a threaded support nut fixed to the upright support and an upright screw in said nut operatively connected to the spider to raise and lower the spider, and in which said gear drive is operatively connected to said upright screw so as to raise the spider simultaneously with outward radial movement of the spindles and lower the spider simultaneously with inward radial movement of said spindles.

14. The combination of claim 13 in which the gear drive comprises a bevel gear journalled on said axis which is a rearward projection of the axis of the tube being formed, a bevel pinion on an end of each of said radial screws and said upright screw, all said bevel pinions meshing with said bevel gear, and means for rotating the bevel gear.

15. The combination of claim 14 in which there is cooperating means on the base and on the spider for pivoting the base plate and the spider about said vertical axis through an arc which is proportional to the vertical movement of the spider and the radial movement of the spindles, so as to automatically adjust the lead angle of the helical path to coincide with the diameter of the tube being formed.

16. The combination of claim 12 in which there is cooperating means on the base and on the spider for pivoting the base plate and the spider about said vertical axis through an arc which is proportional to the vertical movement of the spider and the radial movement of the spindles, so as to automatically adjust the lead angle of the helical path to coincide with the diameter of the tube being formed.

17. The combination of claim 11 which includes an arm extending from the spider forwardly of the output rollers, a strip bending roller carried on said arm between the output rollers and the first of the series of idler rollers to contact the strip and curl it toward said first of the series of idler rollers, and means on said arm for adjusting the position of said bending roller to coordinate said position with the diameter of a tube which is being formed.

18. The combination of claim 17 in which the bending roller has arcuate lands and grooves which match the corrugations of the strip of material, and there is a manually operable worm and gear sector mounted on the arm for moving said bending roller into a desired position.

19. The combination of claim 11 which includes a directing roller supported on the base between the input rollers and the output rollers, and means for adjusting the position of said directing roller to change the angle from the horizontal at which a corrugated strip enters the outfeed rollers, so that said angle may be coordinated with the position of the bending roller.

20. The combination of claim 17 which includes a removable bending pin which is selectively usable in cooperation with the bending roller to bend the strip before it reaches the bending roller.

21. The combination of claim 11 in which the series of idler rollers includes a first idler roller and a last idler roller both of which are removed when tubes of selected small diameters are being formed.

22. The combination of claim 21 which includes a directing roller supported on the base between the input rollers and the output rollers, and means for adjusting the position of said directing roller to change the angle from the horizontal at which a corrugated strip enters the outfeed rollers, so that said angle may be coordinated with the diameter of the tube being formed.

23. In apparatus for helically curling longitudinally corrugated thin strip material into a flexible corrugated tube, said apparatus comprising, a base that has opposite lateral sides, two forwardly extending rotatably driven input rollers carried on said base near one of said opposite lateral sides, said input rollers having intermeshing arcuate lands and grooves forming a nip which matches the corrugations of a strip of material to be helically curled, two forwardly extending rotatably driven output rollers supported on said base, said output rollers having intermeshing arcuate lands and grooves forming a nip to receive a strip of material from said input rollers, a spider supported on said base for rotation about a vertical axis, a series of idler rollers mounted on said spider equidistant from a longitudinal axis which is a rearward projection of the longitudinal axis of a tube being formed, said idler rollers having arcuate lands and grooves to guide said strip of material from the output rollers in a helical path in which each successive turn of the strip passes through the nip of the output rollers in partially overlapped relationship with the strip entering said output rollers to form a tube that is concentric with said longitudinal axis, locking means in said output rollers for crimping overlapping parts of said strip to lock said parts to one another, first means for adjusting said idler rollers radially with respect to said longitudinal axis to form a flexible corrugated tube of a selected diameter within a predetermined range of diameters, second means for adjusting the spider vertically to change the position of said longitudinal axis relative to the nip of the output rollers, and third means for rotating the spider about said vertical axis to change the helix angle of a tube being formed, the improvement comprising:

said first, second and third means are all conjointly operable by rotation of a shaft which is on said axis, said shaft being provided with a drive gear, a series of radially extending screws including a depending screw, each of said screws having a gear driven by the drive gear, and each of said screws except said depending screw being operatively associated with one of the idler rollers for simultaneously moving all said idler rollers selectively radially outwardly or inwardly while retaining them in radially equididtant positions from said longitudinal axis, said depending screw being operatively associated with the base to move the spider vertically by a distance that is equal to the radial movement of the idler rollers, and said third means comprising a cam and cam follower on the base and the spider that produce said rotation of the spider about said vertical axis in response to said vertical movement of the spider.

24. The improvement of claim 23 in which the drive gear is a bevel gear, and the gear on each of said screws is a bevel pinion meshing with said bevel gear.

25. The improvement of claim 23 which includes a support arm on the spider, a rotatable bending roller mounted on said support arm, and a manually operable gear drive on the support arm for adjusting the position of the bending roller relative to the longitudinal axis independently of said first means.

26. The improvement of claim 23 which includes a directing roller supported on the base between the input rollers and the output rollers, and means for adjusting the position of said directing roller to change the angle from the horizontal at which a corrugated strip enters the outfeed rollers, so that said angle may be coordinated with the position of the bending roller.

* * * * *